US009134666B2

(12) United States Patent
Maruko

(10) Patent No.: US 9,134,666 B2
(45) Date of Patent: Sep. 15, 2015

(54) FIXING DEVICE AND IMAGE FORMING APPARATUS

(71) Applicant: Konica Minolta, Inc., Tokyo (JP)

(72) Inventor: Masami Maruko, Hachioji (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/327,966

(22) Filed: Jul. 10, 2014

(65) Prior Publication Data

US 2015/0016840 A1 Jan. 15, 2015

(30) Foreign Application Priority Data

Jul. 12, 2013 (JP) ..... 2013-146052

(51) Int. Cl.
*G03G 15/00* (2006.01)
*G03G 15/20* (2006.01)

(52) U.S. Cl.
CPC ..... *G03G 15/2064* (2013.01); *G03G 15/2078* (2013.01)

(58) Field of Classification Search
CPC ..... G03G 15/2064; G03G 15/2078
USPC ..... 399/67, 126, 328, 333
See application file for complete search history.

(56) References Cited

U.S. PATENT DOCUMENTS 6,253,046 B1 * 6/2001 Horrall et al. ..... 399/124
6,615,019 B2 * 9/2003 Fujimoto ..... 399/367

FOREIGN PATENT DOCUMENTS

| | | | |
|---|---|---|---|
| JP | 05107833 | A | 4/1993 |
| JP | 07295429 | A | 11/1995 |
| JP | 2001343855 | A | 12/2001 |
| JP | 2003177625 | A | 6/2003 |
| JP | 2006259738 | A | 9/2006 |
| JP | 2010072173 | A | 4/2010 |

OTHER PUBLICATIONS

Japanese Notification of Reasons for Refusal corresponding to Application No. 2013-146052; Date of Mailing: Jun. 23, 2015, with English translation.

* cited by examiner

*Primary Examiner* — Hoang Ngo
(74) *Attorney, Agent, or Firm* — Cantor Colburn LLP

(57) ABSTRACT

A fixing device includes a pair of detachable rollers and applies heat and pressure to a sheet nipped between the rollers to fix a toner image formed on the sheet to the sheet. The fixing device includes a biasing part which gives a biasing force to bring one of the rollers into tight contact with the other, an adjusting part which adjusts the biasing force of the biasing part, and a guide indication part providing a guide for an amount of adjustment to be made by the adjusting part in accordance with the hardness of the surface layer of a roller of the rollers.

8 Claims, 8 Drawing Sheets

FIXING DEVICE AND IMAGE FORMING APPARATUS

CROSS REFERENCE TO RELATED APPLICATIONS

The present invention claims priority under 35 U.S.C. §119 to Japanese Application No. 2013-146052 filed Jul. 12, 2013, the entire content of which is incorporated herein by reference.

BACKGROUND OF THE INVENTION

1. Field of the Invention

The present invention relates to a fixing device and an image forming apparatus.

2. Description of Related Art

A fixing device of an image forming apparatus applies heat and pressure to a sheet, on which a toner image has been formed, with the sheet between a fixing roller and a pressure roller each having an elastic material layer on its surface. The fixing device thus fixes the toner image on the sheet.

The support shaft of the pressure roller of such a fixing device is rotatably supported by support arms, to which biasing members such as coil springs are attached. The biasing force of the biasing members allows the pressure roller to press the fixing roller at a given pressing force to maintain a constant nip width of the nip portion formed by the fixing roller and the pressure roller (see, for example, Japanese Unexamined Patent Application Publication Nos. 2006-259738 and 2003-177625).

In a process of producing conventional fixing devices, the biasing force of a biasing member is adjusted while the pressing force between a fixing roller and a pressure roller is measured, so that the nip width will be a given width.

The pressure roller and fixing roller of such a fixing device are detachable to be replaced when worn out.

If the hardness of a pressure roller etc. is the same before and after the replacement, the pressing forces to be obtained are the same before and after the replacement. In this case, a nip width can be maintained constant before and after the replacement. This enables maintenance of constant fixing properties and load torque of the roller, achieving uniform printing results.

Unfortunately, however, the hardness of a pressure roller etc. for replacement is not necessarily constant but varies from roller to roller. A change in hardness of a pressure roller etc. before and after the replacement results in a change in nip width. This leads to a change in fixing properties and load torque of the roller, making it difficult to achieve uniform printing results. In order to maintain the nip width at a given width, it is necessary to adjust the biasing force of a biasing member while measuring the pressing force each time a pressure roller etc. is replaced, which requires great workload.

SUMMARY OF THE INVENTION

The present invention, which has been made in view of the above-described circumstances, aims to provide a fixing device and an image forming apparatus which only require less workload and can maintain a constant nip width when a roller, such as a pressure roller, is replaced.

To solve at least one of the problems described above, a fixing device reflecting an aspect of the present invention includes a pair of detachable rollers and applies heat and pressure to a sheet nipped between the rollers to fix a toner image formed on the sheet to the sheet, the fixing device including: a biasing part which gives a biasing force to bring one of the rollers into tight contact with the other of the rollers; an adjusting part which adjusts the biasing force of the biasing part; and a guide indication part providing a guide for an amount of adjustment to be made by the adjusting part in accordance with hardness of a surface layer of a roller of the rollers.

Preferably, in the fixing device, the adjusting part includes a screw and a screw receiver, to which the screw is fitted, and the biasing force of the biasing part is adjusted by rotation of the screw.

Preferably, the fixing device further includes a fixing member which fixes the screw and the screw receiver to each other to prevent a change in relative positions of the screw and the screw receiver.

Preferably, the fixing device further includes a restricting member which restricts a range of the adjustment to be made by the adjusting part.

Preferably, in the fixing device, the roller is accompanied by identification information for identification of the hardness of the surface layer of the roller.

An image forming apparatus reflecting another aspect of the present invention includes an image forming unit which forms a toner image on a sheet; and the fixing device which fixes the toner image, formed on the sheet by the image forming unit, to the sheet.

An image forming apparatus reflecting another aspect of the present invention includes an image forming unit which forms a toner image on a sheet; a fixing device which includes a pair of detachable rollers and applies heat and pressure to the sheet nipped between the rollers to fix the toner image formed on the sheet to the sheet; a biasing part which gives a biasing force to bring one of the rollers into tight contact with the other of the rollers; an adjusting part which adjusts the biasing force of the biasing part; a driving unit which drives the adjusting part; and a control unit which controls the driving unit to allow the adjusting part to adjust the biasing force of the biasing part to a biasing force corresponding to hardness information on hardness of a surface layer of a roller of the rollers.

Preferably, in the image forming apparatus, the roller is accompanied by identification information for identification of the hardness of the surface layer of the roller.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DESCRIPTION OF THE PREFERRED EMBODIMENTS

Embodiments of the present invention will now be described. The description is not to limit the technical scope of the claims and the meanings of the terms.

First Embodiment

First, an image forming apparatus in accordance with the first embodiment is described.

Figure 1:
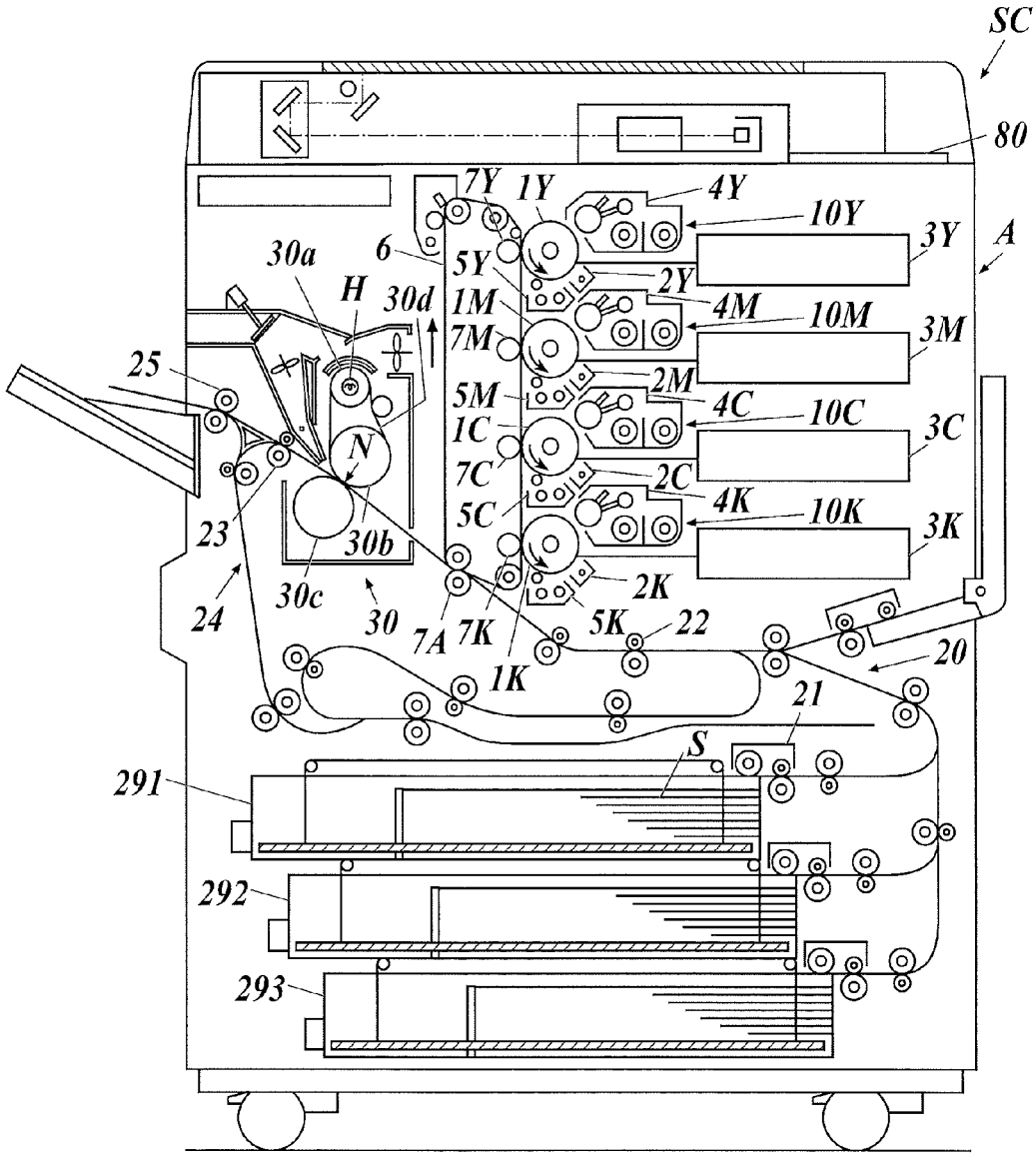
FIG. 1 is a view showing an image forming apparatus in accordance with the present invention.

FIG. 1 is a view showing an image forming apparatus A in accordance with the present invention.

The image forming apparatus A, which is called a tandem color image forming apparatus, performs color image formation with four sets of image forming units.

The image of a document placed on a document plate is scanned and exposed with an optical system of a scanning exposure device of an image scanner SC and is read into a line image sensor. Photoelectrically-converted image information signals undergo analog processing, A/D conversion, shading correction, and image compression in an image processor (not shown in the drawing), and then are inputted to the optical writing section in each of the image forming units.

The four image forming units consist of an image forming unit 10Y to form an image in yellow (Y), an image forming unit 10M to form an image in magenta (M), an image forming unit 10C to form an image in cyan (C), and an image forming unit 10K to form an image in black (K). The alphabetical references Y, M, C, and K that represent the respective colors are suffixed to the common numerical reference 10.

The image forming unit 10Y has a photoreceptor drum 1Y, a charging section 2Y, an optical writing section 3Y, a developing device 4Y, and a drum cleaner 5Y, which are disposed around the photoreceptor drum 1Y.

Similarly, the image forming unit 10M has a photoreceptor drum 1M, a charging section 2M, an optical writing section 3M, a developing device 4M, and a drum cleaner 5M, which are disposed around the photoreceptor drum 1M; the image forming unit 10C has a photoreceptor drum 1C, a charging section 2C, an optical writing section 3C, a developing device 4C, and a drum cleaner 5C, which are disposed around the photoreceptor drum 1C; the image forming unit 10K has a photoreceptor drum 1K, a charging section 2K, an optical writing section 3K, a developing device 4K, and a drum cleaner 5K, which are disposed around the photoreceptor drum 1K.

The photoreceptor drums 1Y, 1M, 1C, and 1K of the image forming units 10Y, 10M, 10C, and 10K, respectively, have a common construction. Similarly, the charging sections 2Y, 2M, 2C, and 2K; the optical writing sections 3Y, 3M, 3C, and 3K; the developing devices 4Y, 4M, 4C, and 4K; and the drum cleaners 5Y, 5M, 5C, and 5K each have a common structure. The alphabetical references Y, M, C, and K are not included in the description below unless it is necessary to particularly distinguish them.

In the image forming unit 10, image information signals are written onto the photoreceptor drum 1 by the optical writing section 3 to form a latent image on the photoreceptor drum 1 based on the image information signals. Then, the latent image is developed by the developing device 4 to form a toner image as a visible image on the photoreceptor drum 1.

Images in yellow (Y), magenta (M), cyan (C), and black (K) are formed on the respective photoreceptor drums 1Y, 1M, 1C, and 1K of the image forming units 10Y, 10M, 10C, and 10K, respectively.

An intermediate transfer belt 6 is stretched over and supported by a plurality of rollers in such a way that the intermediate transfer belt 6 can run on the rollers.

The toner images in the respective colors formed by the image forming units 10Y, 10M, 10C, and 10K are sequentially transferred onto the moving intermediate transfer belt 6 by primary transfer sections 7Y, 7M, 7C, and 7K, and thereby a color image is formed composed of color layers of yellow (Y), magenta (M), cyan (C), and black (K) laid on one another.

A sheet conveying section 20 conveys sheets S. The sheets S are stored in sheet feeding trays 291, 292, and 293, fed by sheet feeding units 21, and conveyed to a secondary transfer section 7A through registration rollers 22. The color image on the intermediate transfer belt 6 is then transferred onto a sheet S. After the color image is transferred onto the sheet S, a fixing device 30 applies heat and pressure to the sheet S to fix the toner image, which has been formed on the sheet S, to the sheet S. The sheet S then passes through fixing/conveying rollers 23 and sheet ejecting rollers 25 and is ejected to the exterior of the apparatus.

The image forming apparatus A has a sheet turning-over section 24. A sheet, on which fixing has been performed, is sent from the fixing/conveying rollers 23 to the sheet turning-over section 24, which turns over the sheet and ejects it. Furthermore, the sheet turning-over section 24 allows image formation on two sides of a sheet.

The size and number of sheets S for image forming can be set through an operation display unit 80 in the upper part of the main body of the image forming apparatus A.

Figure 2:
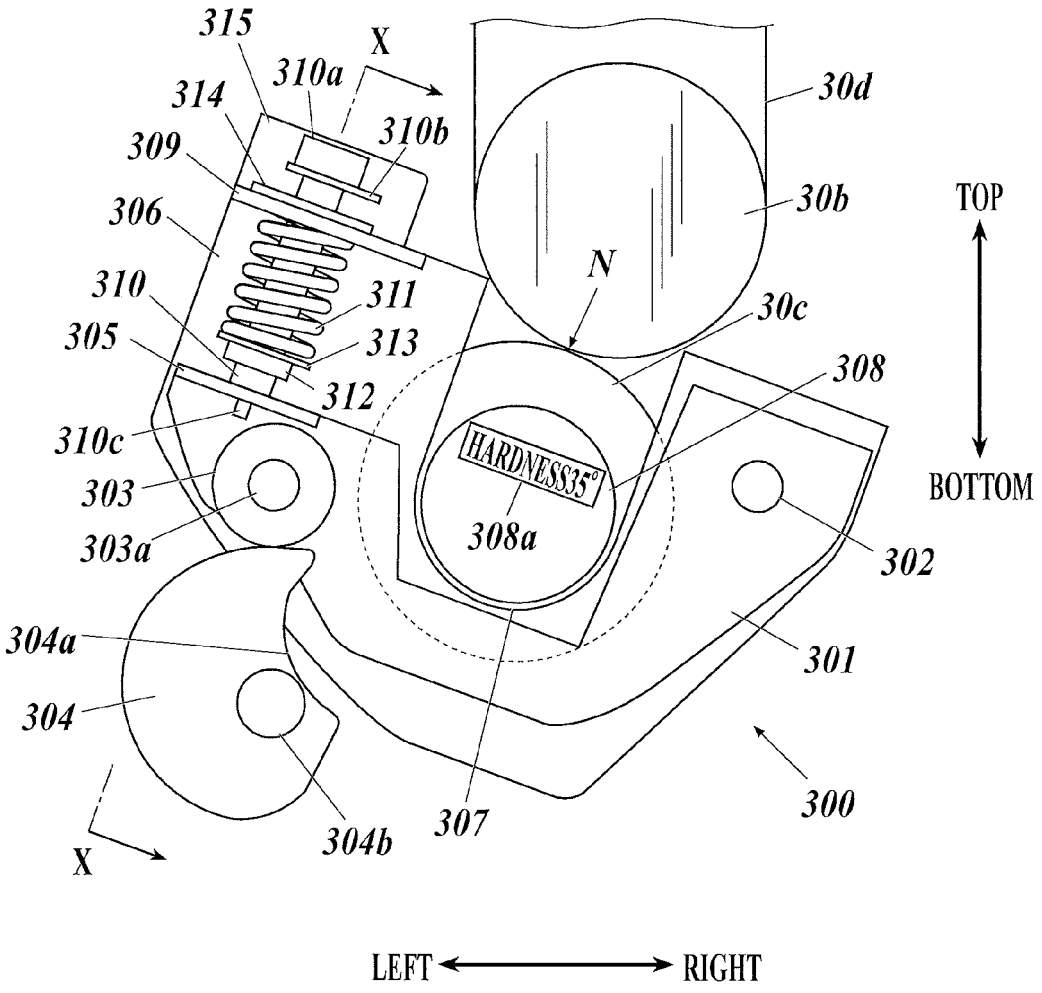
FIG. 2 schematically shows an enlarged portion of a fixing device.

The fixing device 30 includes a heating roller 30*a*, a fixing roller 30*b*, a pressure roller 30*c*, a fixing belt 30*d*, and pressure applying devices 300 (see FIG. 2).

The heating roller 30*a* contains a high-power heater H in it. The heating roller 30*a* rotates in the forward direction with respect to the conveying direction of sheet S and heats the fixing roller 30*b* through the fixing belt 30*d*.

The fixing roller 30*b* has an elastic material layer (surface layer) on its outer periphery, which elastic material layer is made of, for example, rubber or synthetic resin. The fixing roller 30*b* rotates in the forward direction with respect to the conveying direction of sheet S and applies heat and pressure to the face, on which fixing is to be performed, of a conveyed sheet S.

The pressure roller 30*c* has an elastic material layer (surface layer) on its outer periphery, which elastic material layer is made of, for example, rubber or synthetic resin. The pressure roller 30*c* rotates in the forward direction with respect to the conveying direction of sheet S and applies pressure to the face, on which fixing is not to be performed, of a conveyed sheet S. The pressure roller 30*c* can come into and out of contact with the fixing roller 30*b*.

The fixing belt 30*d* is stretched over the heating roller 30*a*. The fixing roller 30*b* rotates in the forward direction with respect to the conveying direction of sheet S in conjunction with the rotations of the heating roller 30*a* and the fixing roller 30*b*.

The fixing roller 30*b* and the pressure roller 30*c* press each other's outer periphery surface to form a nip portion N. The fixing roller 30*b*, which is driven by, for example, a motor, and the pressure roller 30*c*, which is in tight contact with the fixing roller 30*b* and driven by the fixing roller 30*b*, nip a sheet S at the nip portion N. The fixing roller 30*b* and the pressure roller 30*c* apply pressure and heat, thereby performing fixing processing on the sheet S. The fixing roller 30*b* and the pressure roller 30*c* send a sheet S in a predetermined direction (e.g., leftward from the nip portion N in FIG. 1) while performing the fixing processing on the sheet S at the nip portion N.

In this embodiment, the fixing belt 30*d* is stretched over the heating roller 30*a* and the fixing roller 30*b* to be heated. Further, the fixing roller 30*b* and the pressure roller 30*c*, which are heated by the heating roller 30*a* through the fixing belt 30*d*, apply heat and pressure to sheets S. The process of applying heat and pressure to sheets S, however, is not limited to this. For example, the fixing roller 30*b* and the fixing belt 30*d* may be omitted, and the heating roller 30*a* and the pressure roller 30*c* may be brought into tight contact with each other to form a nip portion N to apply heat and pressure to sheets S.

Next, the outline of the fixing device 30 of this embodiment is described with reference to FIGS. 2 and 3.

Figure 3:
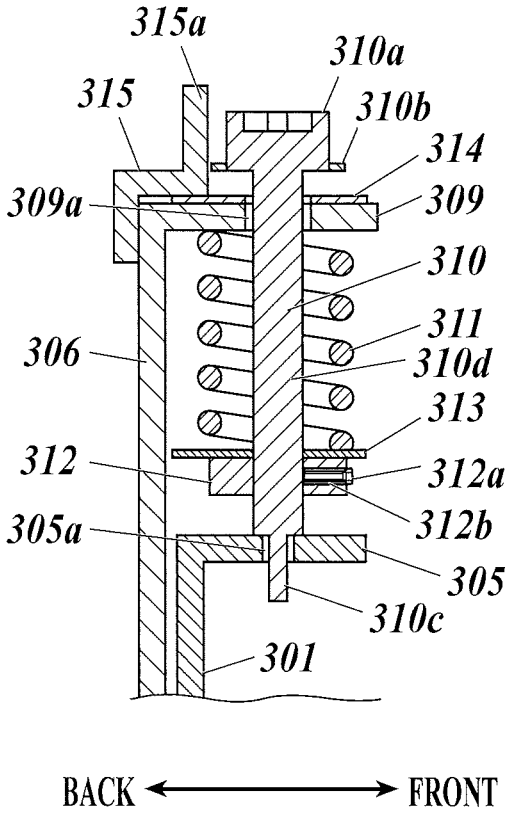
FIG. 3 is an enlarged cross-sectional view along the line X-X of FIG. 2.

In FIGS. 2 and 3, the left/right direction, the top/bottom direction, and the front/back direction perpendicular to the left/right and top/bottom directions are shown for explanation.

As shown in FIG. 2, the both ends of the pressure roller 30*c*, with respect to the longitudinal direction of the pressure roller 30*c*, is supported by a pair of pressure applying devices 300 disposed in a frame (not shown). The pressure applying devices 300 allow the state of the fixing roller 30*b* and the pressure roller 30*c* to switch between a tight contact state and a separating state.

Each pressure applying device 300 includes an almost L-shaped flat drive arm 301. The drive arm 301 can rotate about the rotation axis 302 disposed at one end part of the drive arm 301. A pressure contact follower 303 rotatable about the rotation axis 303*a* is integrally disposed at the other end part of the drive arm 301. The pressure contact follower 303 is pressed by a pressure contact cam 304 disposed near the drive arm 301.

The pressure contact cam 304 has a concave part 304*a* gouged along an arc shape in a part of the ellipsoidal periphery. The pressure contact cam 304 is supported pivotally and eccentrically by the rotation axis 304*b*. The rotation axis 304*b* is connected to a pressure contact motor (not shown), and driving the pressure contact motor rotates the pressure contact cam 304.

An L-shaped flange 305, bent toward the front side, is disposed at the upper end part of the drive arm 301 and near the pressure contact follower 303. As shown in FIG. 3, the flange 305 has a screw hole 305*a* roughly in its center.

A flat support arm 306 is disposed on the rear side of the drive arm 301. One end part of the support arm 306 is supported pivotally by the rotation axis 302 along with the drive arm 301. The drive arm 301 and the support arm 306 can rotate independently from each other. A recess part 307 is scooped out in the shape of a "U" from the upper edge of the support arm 306 roughly in the center of the support arm 306. The bottom of the recess part 307 holds the roller axis 308 of the pressure roller 30*c*.

A hardness indication part 308*a* to display the hardness of the elastic material layer formed on the outer periphery of the pressure roller 30*c* is provided on a lateral face of the roller axis 308. The information displayed on the hardness indication part 308*a* is not limited to the hardness of the elastic material layer but may be specific characters/symbols or a bar code/two-dimensional code readable with a predetermined reader. The hardness indication part 308*a* may be constituted of an IC tag containing information indicating hardness to be read with a predetermined reader, instead of the presentation of the above-described information. While the hardness indication part 308*a* is provided on the pressure roller 30*c* in this embodiment, the hardness indication part 308*a* may alternatively be provided on the outer periphery surface of a case in which the pressure roller 30*c* is carried, for example. Alternatively, the hardness indication part 308*a* may be contained in a case along with the pressure roller 30*c*. In other words, the hardness indication part 308*a*, which is identification information for identification of the hardness of the elastic material layer of the pressure roller 30*c*, is presented in such a way as to accompany the pressure roller 30*c*. The hardness indication part 308*a* may be omitted in this embodiment.

An L-shaped flange 309, bent toward the front side, is provided at the upper edge of the other end part of the support arm 306 so as to be opposed to the flange 305. As shown in FIG. 3, the flange 309 has a screw hole 309*a* roughly in its center.

A spring adjusting screw 310 is inserted in the up/down direction through the screw hole 309*a* in the flange 309 of the support arm 306 and through the screw hole 305*a* in the flange 305 of the drive arm 301. A pressure contact spring 311 is wound around the spring adjusting screw 310 between the flange 309 of the support arm 306 and the spring contact plate 313.

The spring adjusting screw 310 includes a screw head part 310*a* at the upper part having a cross-shaped groove to receive a jig, such as a driver, used for rotation; a main body part 310*d* extending from the bottom of the screw head part 310*a*, part of the outer periphery of the main body part 310*d* being threaded; and a screw tip part 310*c* extending from the bottom of the main body part 310*d* and having a diameter smaller than that of the main body part 310*d*.

A guide part 310*b* is provided on the outer periphery of the bottom of the screw head part 310*a*, the guide part 310*b* and the screw head part 310*a* being integral.

The spring adjusting screw 310, which is configured in such a manner, is fixed to extend through the screw hole 309*a* of the flange 309 of the support arm 306, with the screw tip part 310*c* extending through the screw hole 305*a* of the flange 305 of the drive arm 301. The bottom edge part of the main body part 310*d*, i.e., the boundary part between the main body part 310*d* and the screw tip part 310*c* of the spring adjusting screw 310, is in contact with the top surface of the flange 305 of the drive arm 301, preventing the main body part 310*d* from passing through the screw hole 305*a*.

The main body part 310*d* of the spring adjusting screw 310 is screwed in a screw receiver 312, whose inner periphery is threaded. On the top surface of the screw receiver 312, a spring contact plate 313 is disposed in such a way that the spring adjusting screw 310 penetrates the spring contact plate 313. The screw receiver 312 and the spring contact plate 313 are engaged with each other to be integral, and the spring contact plate 313 is locked onto the support arm 306, for example, to prevent the screw receiver 312 and the spring contact plate 313 from rotating.

A screw receiving hole 312*b*, into which a fixing screw 312*a* is to be screwed, extends through the screw receiver 312 from its lateral face to its inner periphery. The fixing screw 312*a* is screwed into the screw receiving hole 312*b* in the screw receiver 312, and the tip of the fixing screw 312*a* presses the outer periphery of the spring adjusting screw 310. This prevents the spring adjusting screw 310 from loosening.

In other words, the fixing screw 312*a* prevents a change of the relative positions of the spring adjusting screw 310 and the screw receiver 312.

The top edge of the pressure contact spring 311 is in contact with the undersurface of the flange 309 of the support arm 306, and the bottom edge of the pressure contact spring 311 is in contact with the spring contact plate 313. The pressure contact spring 311 is wound around the spring adjusting screw 310 in such a way that the flange 309 and the spring contact plate 313 are spring-biased to be separated from each other.

A rotation restricting member 315 is disposed at the rear end part of the flange 309 of the support arm 306. The rotation restricting member 315, which will be described later in detail, restricts the rotation range of the spring adjusting screw 310.

Figure 4:
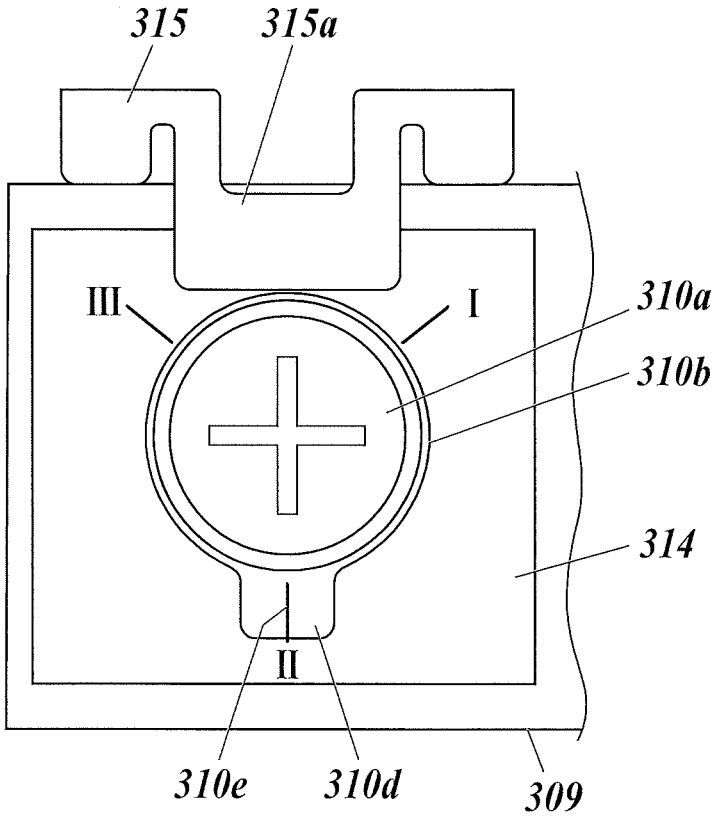
FIG. 4 is a view showing a scale indication part.

As shown in FIG. 4, a scale indication part 314 is disposed on the top surface of the flange 309. The scale indication part 314 constitutes a guide indication part to provide a guide in accordance with the hardness of the elastic material layer on the outer periphery of the pressure roller 30*c*. The scale indication part 314 has scale marks at predetermined intervals, the scale marks representing levels of the hardness of the elastic material layer of the pressure roller 30*c*. In this embodiment, the scale marks are represented by "I" to "III". For example, the scale mark "I" indicates that the hardness is 31° to 33°, the scale mark "II" indicates that the hardness is 34° to 36°, and the scale mark "III" indicates that the hardness is 37° to 39°.

The pressure applying device 300, which is configured in such a way as described above, allows the drive arm 301 and the support arm 306 to rotate in the counterclockwise direction with the rotation axis 302 as a support shaft by the weights of the pressure roller 30*c* and the pressure applying device 300 when the pressure contact cam 304 is rotated so that the pressure contact follower 303 faces the concave part 304*a*. The pressure roller 30*c* and the fixing roller 30*b* are then separated from each other.

When the pressure contact cam 304 is rotated so as to press the pressure contact follower 303, the drive arm 301 rotates in the clockwise direction with the rotation axis 302 as a support shaft. The spring contact plate 313, which is attached to the spring adjusting screw 310 in contact with the top surface of the flange 305 of the drive arm 301, then pushes up the pressure contact spring 311. The pressure contact spring 311 pushes up the undersurface of the flange 309 of the support arm 306 by the biasing force, resulting in the rotation of the support arm 306 in the clockwise direction with the rotation axis 302 as a support shaft. This pushes up the pressure roller 30*c* held by the recess part 307 of the support arm 306 and brings the pressure roller 30*c* into tight contact with the fixing roller 30*b* by the pressing force corresponding to the biasing force of the pressure contact spring 311. The nip portion N is thus formed.

The method of adjusting the pressing force of the pressure roller 30*c* to the fixing roller 30*b* will now be described with reference to FIGS. 3 to 5.

The fixing device 30 in this embodiment uses, as a factory default, a pressure roller 30*c* having an elastic material layer with a hardness of 35°. The biasing force of the pressure contact spring 311 is adjusted with a predetermined jig while the pressing force of the pressure roller 30*c* to the fixing roller 30*b* is measured, so that the pressing force is a predetermined value, e.g., 2350 N. This can adjust the nip width of the nip portion N to be a preset width. The factory-default hardness of the elastic material layer of the pressure roller 30*c* is not limited to this. A guide part 310*b* has not been attached to the screw head part 310*a* yet at this stage.

Specifically, as shown in FIG. 3, the fixing screw 312*a* fitted in the screw receiver 312 is loosened so that the spring adjusting screw 310 can rotate relative to the screw receiver 312. The screw head part 310*a* is then operated with a jig, such as a driver, for rotation of the spring adjusting screw 310. The distance between the flange 305 of the drive arm 301 and the screw receiver 312 varies depending on the amount of rotation of the spring adjusting screw 310. In other words, the distance between the flange 305 and the spring contact plate 313 varies. Specifically, the rotation of the spring adjusting screw 310 to tighten the screw 310 increases the distance between the flange 305 and the spring contact plate 313. This causes the spring contact plate 313 to push up the pressure contact spring 311, leading to an increase in biasing force of the pressure contact spring 311. The rotation of the spring adjusting screw 310 to loosen the screw 310 decreases the distance between the flange 305 and the spring contact plate 313. This reduces the upward pressing force of the spring contact plate 313 to the pressure contact spring 311, leading to a decrease in biasing force of the pressure contact spring 311.

After the completion of such an adjustment of the biasing force of the pressure contact spring 311, the fixing screw 312*a* is screwed in the screw receiving hole 312*b* of the screw receiver 312 to prevent the spring adjusting screw 310 from loosening, and the guide part 310*b* is fixed to the screw head part 310*a*. As shown in FIG. 4, the guide part 310*b* is in the shape of a disk and has an opening in its center into which the screw head part 310*a* is to be fitted. A flat protruding part 310*d* is formed at a part of the outer periphery of the guide part 310*b* to be integral with the guide part 310*b*. The protruding part 310*d* has a guide line 310*e* in its center. The guide line 310*e* serves as an indicator to align with a scale mark of the scale indication part 314. The guide part 310*b* is attached to the screw head part 310*a* in such a way that the guide line 310*e* aligns with the line of the scale mark "II" of the scale indication part 314. The guide line 310*e* aligning with the scale mark "II" indicates that the pressure roller 30*c* is pressing the fixing roller 30*b* at the pressing force corresponding to the hardness 34° to 36° of the elastic material layer of the pressure roller 30*c*.

Next, the method of adjusting the pressing force of the pressure roller 30*c* to the fixing roller 30*b* when the pressure roller 30*c* is replaced after the apparatus is brought to the market is described. In this embodiment, the pressing force can be adjusted to be a force corresponding to the hardness of the elastic material layer of the pressure roller 30*c* as described below.

First, a worn-out pressure roller 30*c* is replaced with a new one. The pressure applying devices 300 are then operated so as to bring the pressure roller 30*c* in tight contact with the fixing roller 30*b* as described above.

The pressing force of the pressure roller 30*c* to the fixing roller 30*b* is adjusted so that the nip width of the nip portion N, which is formed by the fixing roller 30*b* and the pressure roller 30*c*, is a given width.

Specifically, as described above, the fixing screw 312*a* fitted in the screw receiver 312 is loosened. The hardness of the elastic material layer of the pressure roller 30*c* after the replacement is checked. The screw head part 310*a* is then operated with a jig, such as a driver, to rotate the spring adjusting screw 310 along with the guide part 310*b* so that the guide line 310*e* on the protruding part 310*d* of the guide part 310*b* aligns with the scale mark corresponding to the hardness of the elastic material layer of the pressure roller 30*c* on the scale indication part 314. This adjusts the pressing force to the force corresponding to the hardness of the elastic material layer of the pressure roller 30*c* after the replacement. After the completion of the adjustment, the fixing screw 312*a* is screwed into the screw receiving hole 312*b* of the screw receiver 312 not to loosen the spring adjusting screw 310.

Figure 5A:
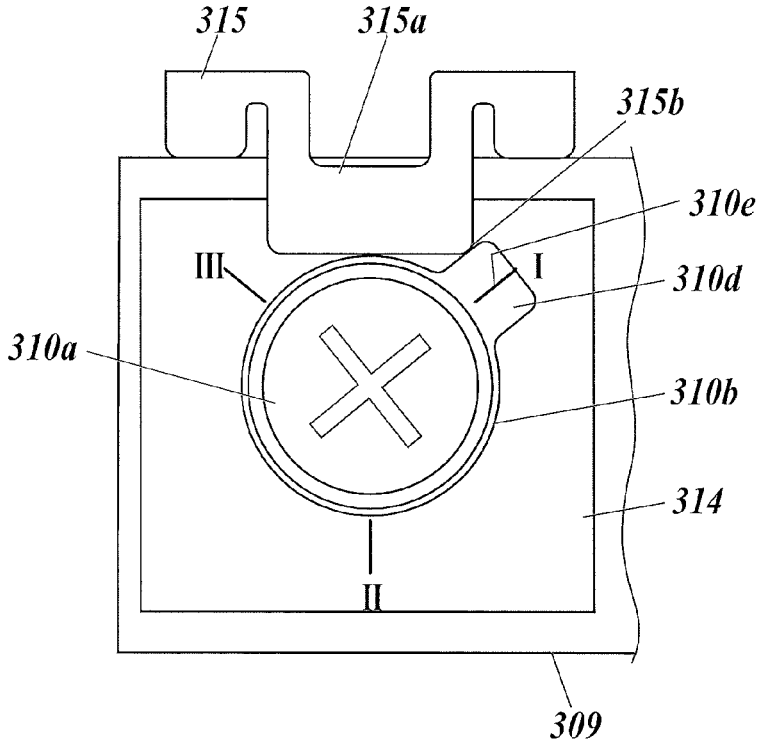
FIG. 5A is a view showing the adjustment of pressing force with a spring adjusting screw.

For example, when the hardness of the elastic material layer of the pressure roller 30*c* is smaller after the replacement than before the replacement, the elastic material layer of the pressure roller 30*c* is made flatter after the replacement than before the replacement by the same pressing force. The nip width of the nip portion N is therefore larger after the replacement. When the guide line 310*e* aligns with the line of the scale mark "II" and the hardness of the elastic material layer of the pressure roller 30*c* after the replacement is 31° to 33° as shown in FIG. 4, the spring adjusting screw 310 is rotated in the counterclockwise direction so that the guide line 310*e* aligns with the scale mark "I" as shown in FIG. 5A. This reduces the distance between the flange 305 and the spring contact plate 313 and reduces the biasing force of the pressure contact spring 311, leading to reduction in pressing force of the pressure roller 30*c* to the fixing roller 30*b*. This reduces the nip width of the nip portion N to a given width. At this time, the protruding part 310*d* of the guide part 310*b* touches a first touching part 315*b* of the rotation restricting member 315, and thus further rotation of the spring adjusting screw 310 is restricted.

Figure 5B:
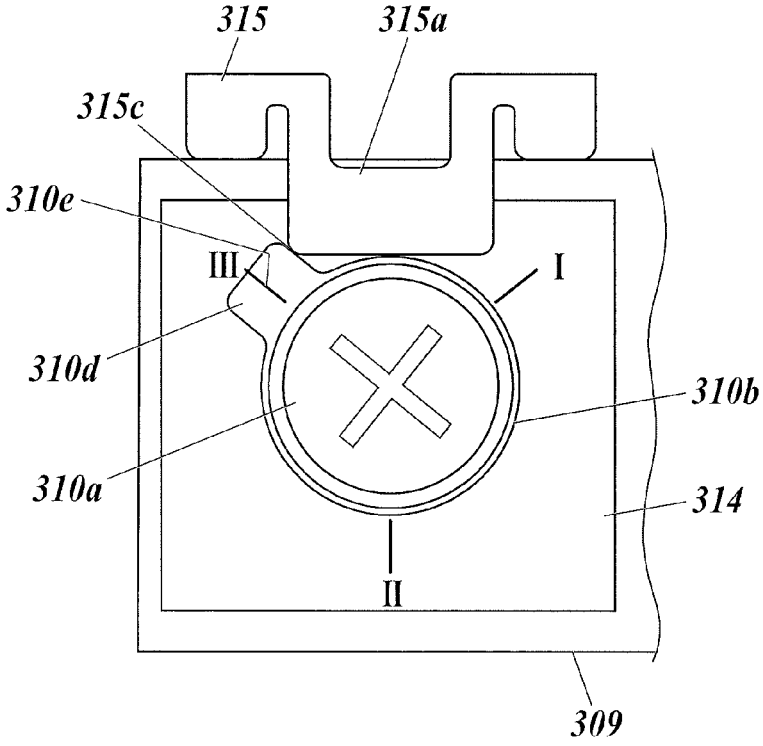
FIG. 5B is a view showing the adjustment of pressing force with a spring adjusting screw.

When the hardness of the elastic material layer of the pressure roller 30*c* is larger after the replacement than before the replacement, the elastic material layer of the pressure roller 30*c* is more difficult to flatten after the replacement than before the replacement by the same pressing force. The nip width of the nip portion N is therefore smaller after the replacement. When the hardness of the elastic material layer of the pressure roller 30*c* after the replacement is 37° to 39°, the spring adjusting screw 310 is rotated in the clockwise direction so that the guide line 310*e* aligns with the scale mark "III" as shown in FIG. 5B. This increases the distance between the flange 305 and the spring contact plate 313 and increases the biasing force of the pressure contact spring 311, leading to an increase in pressing force of the pressure roller 30*c* to the fixing roller 30*b*. This increases the nip width of the nip portion N to a given width. At this time, the protruding part 310*d* of the guide part 310*b* touches a second touching part 315*c* of the rotation restricting member 315, and thus further rotation of the spring adjusting screw 310 is restricted.

Figure 6:
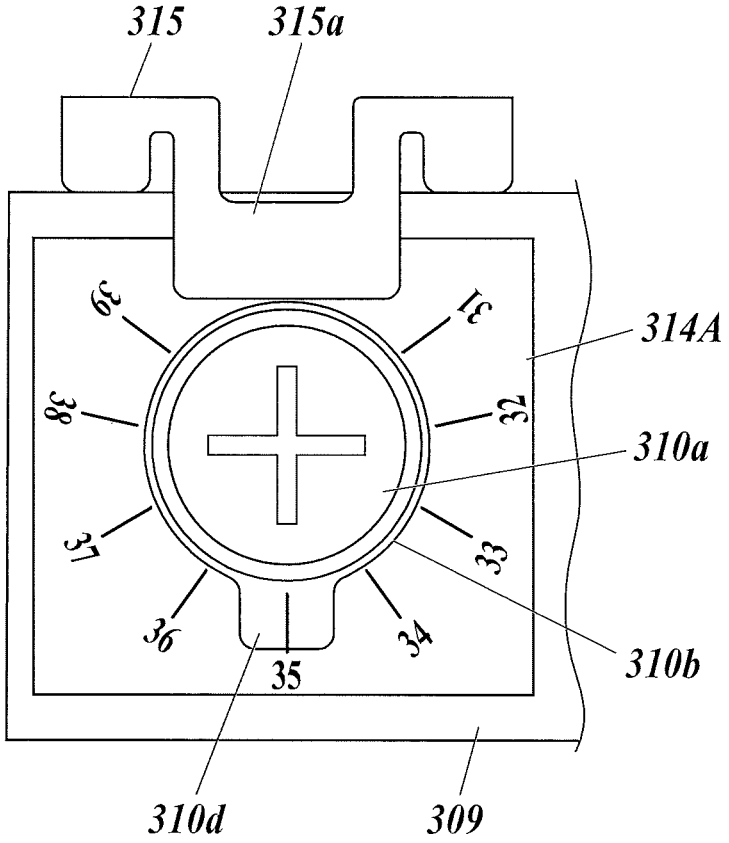
FIG. 6 is a view showing another example of a scale indication part.

In this embodiment, the hardness of the elastic material layer of the pressure roller 30*c* is divided into three levels and the scale indication part 314 has the scale marks "I" to "III" representing the levels. Alternatively, a scale indication part 314A as shown in FIG. 6 may be used. The scale indication part 314A has scale marks "31°" to "39°" corresponding to the hardness levels of the elastic material layer of the pressure roller 30*c*. This achieves a finer adjustment.

As described above, in the first embodiment, the pressure contact spring 311 gives a biasing force for the fixing roller 30*b* to come into tight contact with the pressure roller 30*c*. The spring adjusting screw 310 adjusts the biasing force of the pressure contact spring 311. The guide part 310*b* and the scale indication part 314 provide a guide for an amount of adjustment to be made by the spring adjusting screw 310 in accordance with the hardness of the surface layer of the pressure roller 30*c*. Accordingly, an operator can easily adjust the biasing force of the biasing part in accordance with the hardness of the surface layer of the pressure roller while checking the guide when replacing the pressure roller. This reduces workload and maintains a constant nip width. This also tolerates variation in hardness of surface layers at the time of manufacture of rollers, improving roller productivity.

In the first embodiment, the biasing force of the pressure contact spring 311 is adjusted through the rotation of the spring adjusting screw 310. This achieves the adjustment with a simple means.

In the first embodiment, the fixing screw 312*a* fixes the spring adjusting screw 310 and the screw receiver 312 to each other to prevent a change in their relative positions. This prevents the adjusting part from loosening due to vibration caused when the rollers come out of tight contact, for example.

In the first embodiment, the rotation restricting member 315 restricts the range of adjustment to be made by the spring adjusting screw 310. This clarifies the adjustment range and achieves easy adjustment.

In the first embodiment, the pressure roller 30*c* is accompanied by the hardness indication part 308*a* for identification of the hardness of the surface layer of the pressure roller 30*c*. This allows an operator to exactly know the hardness of the roller surface layer in adjusting the biasing force of the biasing part, achieving precise adjustment.

Second Embodiment

A second embodiment of the present invention will now be described. The basic configuration of an image forming apparatus B of the second embodiment is substantially the same as that of the image forming apparatus A of the first embodiment. The same components are indicated by the same reference numbers/alphabets between the image forming apparatuses A and B, and redundant explanations are omitted.

Figure 7:
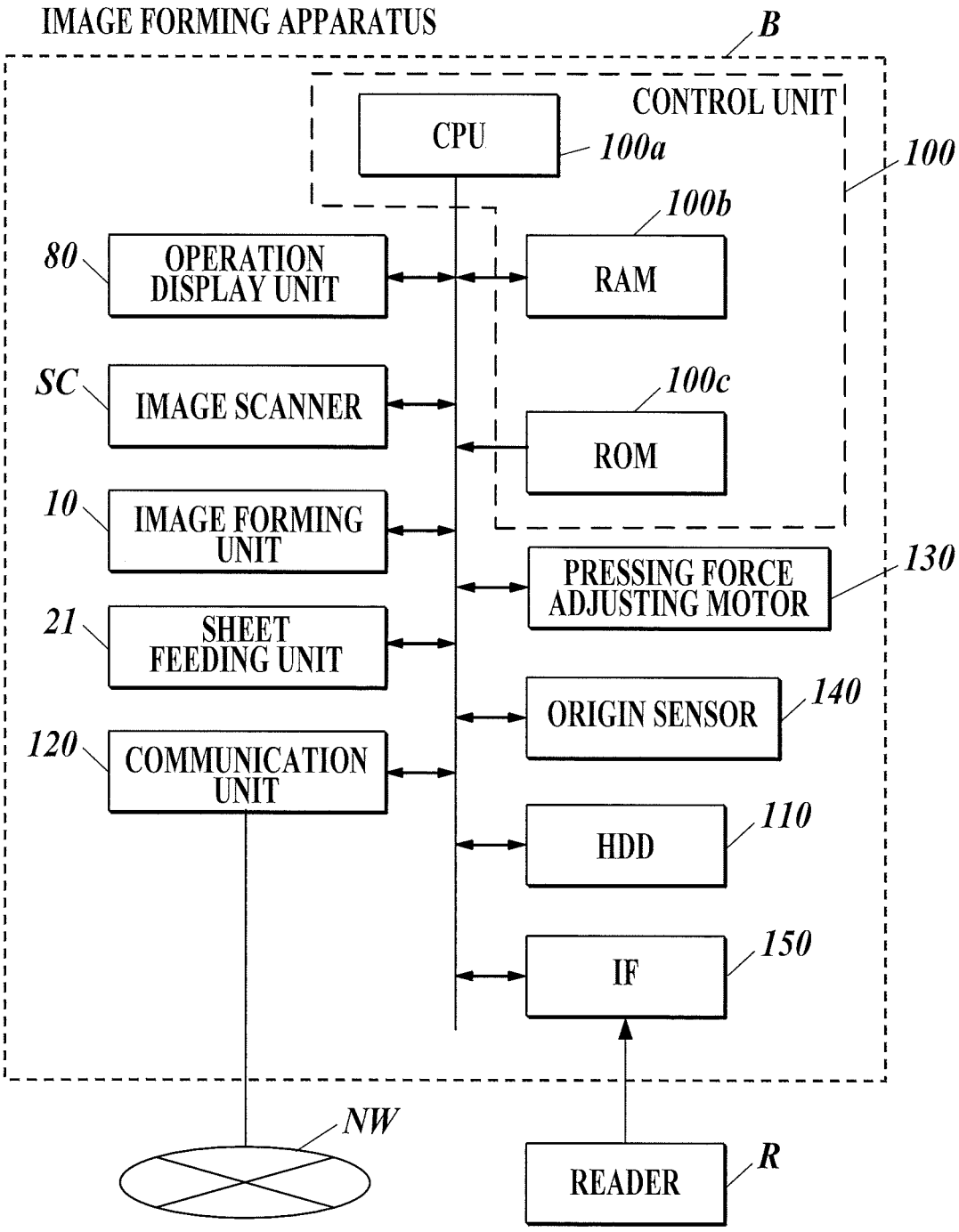
FIG. 7 is a block diagram showing the functional configuration of an image forming apparatus in accordance with the second embodiment.

First, the configuration of the control system of the image forming apparatus B is described. As shown in FIG. 7, the image forming apparatus B includes a control unit 100, a hard disk drive (HDD) 110, a communication unit 120, a pressing force adjusting motor 130, an origin sensor 140, and an interface (IF) 150, in addition to the image scanner SC, the image forming unit 10, the sheet feeding units 21, and the operation display unit 80 described above.

The HDD 110 stores various pieces of data in accordance with the instructions from the control unit 100.

The operation display unit 80 includes, for example, a liquid crystal display (LCD), a touch panel, and a numerical keypad. The operation display unit 80 receives a display signal from the control unit 100 for display on the LCD, and outputs an operational signal inputted from the touch panel and the numerical keypad to the control unit 100. In this embodiment, the operation display unit 80 can input the hardness information of the pressure roller 30*c* and give instructions for adjustment of the pressing force of the pressure roller 30*c*.

The communication unit 120 is an interface connectable to a transmission medium connected to a communication network NW, such as a local area network (LAN) and a wide area network (WAN). The communication unit 120 is constituted of a communication control card, such as a LAN card, and transmits and receives various pieces of data to and from an external device, such as a host device, connected to the communication network NW through a communication line, such as a LAN cable.

The control unit 100 is constituted of, for example, a central processing unit (CPU) 100*a*, a random access memory (RAM) 100*b*, and a read only memory (ROM) 100*c*. The ROM 100*c* contains various processing programs, and the CPU 100*a* reads out a program stored in the ROM 100*c* to expand the read-out program into the RAM 100*b*. The CPU

100*a* controls the behavior of each component of the image forming apparatus B in accordance with the expanded program.

For example, when receiving an input of image data from the image scanner SC or the communication unit 120, the control unit 100 performs various image processing on the inputted image data and outputs the processed image data for each page to the image forming unit 10 to allow the image forming unit 10 to perform image formation. Examples of such image processing include conversion of RGB image data, inputted from the image scanner SC, into YMCK image data; and conversion of image data, inputted from a host device (not shown) through the communication unit 120, to YMCK image data in the format suitable for image formation by the image forming apparatus B with a predetermined page-description language.

Figure 8:
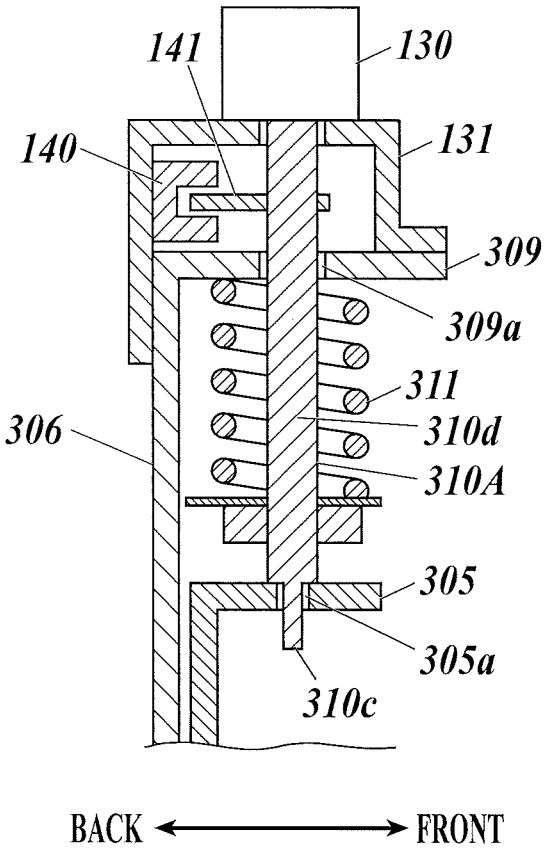
FIG. 8 is an enlarged cross-sectional view showing the structure of a spring adjusting screw.

The pressing force adjusting motor 130 is connected to the head of a spring adjusting screw 310A as shown in FIG. 8.

The pressing force adjusting motor 130 is connected to the head of the spring adjusting screw 310A via a rotation axis to be rotated by the motor and via a connection, such as a gear, connected to the rotation axis (which are not shown), for example.

The pressing force adjusting motor 130 rotates the spring adjusting screw 310A forward and reversely in accordance with a control signal from the control unit 100. Specifically, a support member 131 having a U-shaped cross section is attached to the top surface of the flange 309 of the support arm 306. The pressing force adjusting motor 130, to which the spring adjusting screw 310A is rotatably attached, is fixed to the top surface of the support member 131. The amount of rotation of the pressing force adjusting motor 130, i.e., the amount of rotation of the spring adjusting screw 310A, can be detected with a signal outputted from an encoder disposed on the pressing force adjusting motor 130, for example.

The origin sensor 140 is constituted of a photosensor including a light-emitting part and a light-receiving part to receive light from the light-emitting part. The origin sensor 140 outputs an origin detection signal to the control unit 100 when the spring adjusting screw 310A is at an origin position. Specifically, as shown in FIG. 8, the origin sensor 140 is attached to a proper position on the inner periphery of the lateral wall of the support member 131. A detection piece 141 for blocking light from the light-emitting part of the origin sensor 140 is disposed at a predetermined position of the spring adjusting screw 310A integrally. The detection piece 141 is disposed at such a position as to block the light of the origin sensor 140 when the pressure roller 30*c* presses the fixing roller 30*b* at a predetermined pressing force when the hardness of the elastic material layer of the pressure roller 30*c* is 35°, for example. This position is the origin position of the spring adjusting screw 310A. A sensor used as the origin sensor 140 is not limited to a photosensor but may be any other sensor that can detect the origin position.

The IF 150 is connectable to a reader R, such as a bar code reader and a radio frequency identification (RFID) reader. The IF 150 outputs data, received from the reader R, to the control unit 100.

Figure 9:
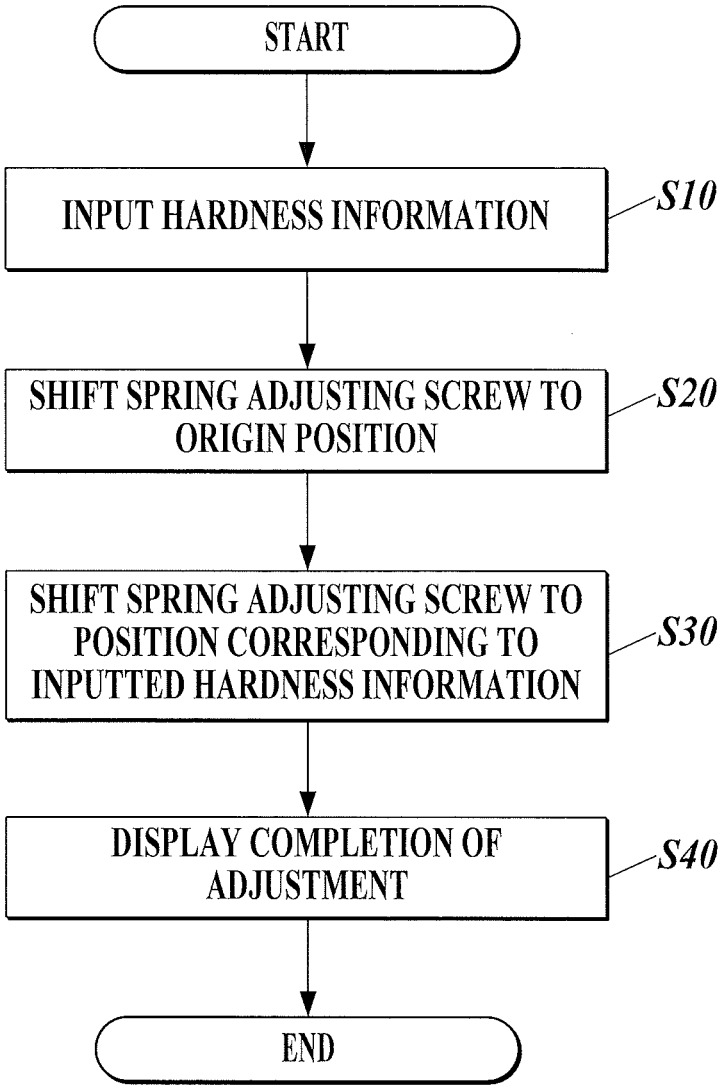
FIG. 9 is a flowchart showing adjustment processing.

Next, the adjustment processing to be executed by the control unit 100 of the image forming apparatus B, which is configured as described above, is described with reference to FIG. 9. The adjustment processing is executed upon a predetermined operation for executing the adjustment by the operation display unit 80, for example.

When hardness information is inputted by the operation display unit 80, or hardness information read by the reader R is inputted (Step S10), the control unit 100 shifts the spring adjusting screw 310A to the origin position (Step S20). The control unit 100 then drives the pressing force adjusting motor 130 so that the spring adjusting screw 310A is at the position corresponding to the inputted hardness information (Step S30). The control unit 100 then displays information indicating that the adjustment has been completed on the screen of the operation display unit 80 (Step S40), and ends the processing.

As described above, in the second embodiment, the image forming unit 10 forms a toner image on a sheet. The fixing device 30, which includes the detachable fixing roller 30*b* and pressure roller 30*c*, applies heat and pressure to the sheet nipped between these rollers 30*b* and 30*c* to fix the toner image formed on the sheet easily. The pressure contact spring 311 gives biasing force to bring the pressure roller 30*c* into tight contact with the fixing roller 30*b*. The spring adjusting screw 310A adjusts the biasing force of the pressure contact spring 311. The pressing force adjusting motor 130 drives the spring adjusting screw 310A. The control unit 100 controls the pressing force adjusting motor 130 to allow the spring adjusting screw 310A to adjust the biasing force of the pressure contact spring 311 to be the biasing force corresponding to hardness information on the hardness of the surface layer of the pressure roller 30*c*. Accordingly, the biasing force of the biasing part can be easily adjusted in accordance with the hardness of the roller surface layer at the time of the replacement of roller. This reduces workload and maintains a constant nip width.

Further, in the second embodiment, the pressure roller 30*c* is accompanied by the hardness indication part 308*a* for identification of the hardness of the surface layer of the pressure roller 30*c*. This allows an operator to exactly know the hardness of the roller surface layer in adjusting the biasing force of the biasing part, achieving precise adjustment.

The description of the embodiments of the present invention just shows example fixing devices and image forming apparatuses in accordance with the present invention, and should not be construed as limiting the present invention. Detailed configurations and operations of the functional units constituting the fixing devices and the image forming apparatuses may be modified as appropriate.

The rotation restricting member 315 to restrict the range of rotation of the spring adjusting screw 310 provided in the first embodiment may be omitted.

The fixing screw 312*a* prevents the spring adjusting screw 310 from loosening in the first embodiment, but any other fixing means may be employed as long as it prevents the spring adjusting screw 310 from loosening. The fixing screw 312*a* may be omitted.

The biasing force of the pressure contact spring 311 is adjusted directly by the rotation of the spring adjusting screw 310/310A in the embodiments. Alternatively, a linkage mechanism may be interposed to allow indirect adjustment.

In the embodiments, the biasing force of the pressure contact spring 311 is adjusted in accordance with the hardness of the elastic material layer of a new pressure roller 30*c* when a pressure roller 30*c* is replaced. Alternatively, the biasing force of the pressure contact spring 311 may be adjusted in accordance with the hardness of the elastic material layer of a new fixing roller 30*b* when a fixing roller 30*b* is replaced.

In the embodiments, a hard disk or a nonvolatile semiconductor memory is used as a computer-readable medium for the program according to the present invention. The computer-readable medium is, however, not limited to this example. A portable recording medium, such as a CD-ROM, may also be used as the computer-readable medium. A carrier wave may also be used as a medium for providing data of a program according to the present invention through a communication line.

A fixing device according to an aspect of a preferred embodiment of the present invention includes a pair of detachable rollers and applies heat and pressure to a sheet nipped between the rollers to fix a toner image, which has been formed on the sheet, to the sheet. The fixing device includes a biasing part which gives a biasing force to bring one of the rollers into tight contact with the other roller, an adjusting part which adjusts the biasing force of the biasing part, and a guide indication part providing a guide for an amount of adjustment to be made by the adjusting part in accordance with the hardness of the surface layer of a roller of the rollers.

The fixing device reduces workload and maintains a constant nip width at the time of replacement of a roller.

The entire disclosure of Japanese Patent Application No. 2013-146052 filed on Jul. 12, 2013 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A fixing device which includes a pair of detachable rollers and applies heat and pressure to a sheet nipped between the rollers to fix a toner image formed on the sheet, the fixing device comprising:

a biasing part which gives a biasing force to bring one of the rollers into tight contact with the other of the rollers;

an adjusting part which adjusts the biasing force of the biasing part; and a guide indication part providing a guide for an amount of adjustment to be made by the adjusting part in accordance with hardness of a surface layer of a roller of the rollers.

2. The fixing device according to claim 1, wherein the adjusting part includes a screw and a screw receiver, to which the screw is fitted, and the biasing force of the biasing part is adjusted by rotation of the screw.

3. The fixing device according to claim 2, further comprising a fixing member which fixes the screw and the screw receiver to each other to prevent a change in relative positions of the screw and the screw receiver.

4. The fixing device according to claim 1, further comprising a restricting member which restricts a range of the adjustment to be made by the adjusting part.

5. The fixing device according to claim 1, wherein the roller is accompanied by identification information for identification of the hardness of the surface layer of the roller.

6. An image forming apparatus comprising:

an image forming unit which forms a toner image on a sheet; and the fixing device according to claim 1 which fixes the toner image, formed on the sheet by the image forming unit, to the sheet.

7. An image forming apparatus comprising:

an image forming unit which forms a toner image on a sheet;

a fixing device which includes a pair of detachable rollers and applies heat and pressure to the sheet nipped between the rollers to fix the toner image formed on the sheet;

a biasing part which gives a biasing force to bring one of the rollers into tight contact with the other of the rollers;

an adjusting part which adjusts the biasing force of the biasing part;

a driving unit which drives the adjusting part; and a control unit which controls the driving unit to allow the adjusting part to adjust the biasing force of the biasing part to a biasing force corresponding to hardness information on hardness of a surface layer of a roller of the rollers.

8. The image forming apparatus according to claim 7, wherein the roller is accompanied by identification information for identification of the hardness of the surface layer of the roller.

* * * * *